US008033551B2

(12) United States Patent
Tatomir

(10) Patent No.: US 8,033,551 B2
(45) Date of Patent: Oct. 11, 2011

(54) ICE SKATING BLADE

(76) Inventor: Wally Wayne Tatomir, Raleigh, NC (US)

( * ) Notice: Subject to any disclaimer, the term of this patent is extended or adjusted under 35 U.S.C. 154(b) by 58 days.

(21) Appl. No.: 12/633,043

(22) Filed: Dec. 8, 2009

(65) Prior Publication Data

US 2010/0084829 A1 Apr. 8, 2010

Related U.S. Application Data

(62) Division of application No. 11/364,094, filed on Feb. 28, 2006, now Pat. No. 7,648,146.

(60) Provisional application No. 60/659,107, filed on Mar. 8, 2005.

(51) Int. Cl.
*A63C 3/00* (2006.01)

(52) U.S. Cl. ..... 280/11.18; 280/11.12

(58) Field of Classification Search ..... 280/11.18, 280/11.12, 11.17, 11.3, 11.223, 11.14, 7.13, 280/825, 809; 264/239, 299; 33/571, 520, 33/490

See application file for complete search history.

(56) References Cited

U.S. PATENT DOCUMENTS

| | | | | | |
|---|---|---|---|---|---|
| 2,108,128 | A * | 2/1938 | Kinney | 280/11.18 |
| 2,242,870 | A * | 5/1941 | Prosey | 280/11.18 |
| 3,839,828 | A * | 10/1974 | Arnold | 451/239 |
| 3,967,832 | A * | 7/1976 | Chambers | 280/11.12 |
| 4,085,944 | A * | 4/1978 | Chambers | 280/11.12 |
| 4,093,249 | A * | 6/1978 | Chambers | 280/11.12 |
| 4,161,822 | A * | 7/1979 | Ayvazian | 33/571 |
| 4,294,043 | A * | 10/1981 | Sakcriska | 451/239 |
| 4,336,948 | A * | 6/1982 | Couture | 280/11.12 |
| 5,320,368 | A * | 6/1994 | Lang | 280/11.12 |
| 5,354,078 | A * | 10/1994 | BelleIsle | 280/11.18 |
| 6,523,835 | B1 * | 2/2003 | Lyden | 280/11.12 |

* cited by examiner

*Primary Examiner* — Hau Phan

(74) *Attorney, Agent, or Firm* — Coats & Bennett, P.L.L.C.

(57) ABSTRACT

A skate blade has a front curved section having a front balance point, a rear curved section having a rear balance point, and a middle section having a center balance point. Each balance point is a point on the skate blade over which a skater's center of gravity lies depending on the skater's position. The skate blade is shaped such that the middle section is substantially flat. Additionally, the blade is shaped such that more of the blade extends away from a blade holder at the rear balance point than at the front balance point.

9 Claims, 6 Drawing Sheets

ICE SKATING BLADE

RELATED APPLICATIONS

This application is a divisional application of, and claims priority under 35 U.S.C. §121 from, U.S. application Ser. No. 11/364,094 filed Feb. 28, 2006, which claims priority under 35 U.S.C. §119(e) from U.S. provisional Application No. 60/659,107 filed on Mar. 8, 2005. Both the '094 application and the '107 provisional application are incorporated herein by reference in their entirety.

BACKGROUND

The present invention relates generally to an ice skating blade, and more particularly to an ice skating blade shaped to improve skater performance, balance, and control.

Ice skating is a favorite activity for many people. Skaters usually glide along an ice surface, periodically make turns, transition between forward and backward skating, and quickly accelerate and decelerate at various times. Each of these actions requires that the skater maintain balance and control his or her movements.

The shape of conventional ice skating blades or runners, however, forces the skater to work harder to maintain balance and control. This is because most conventional blades are curved from the toe (i.e., front) of the blade to the heel (i.e., back) of the blade. Thus, whenever a skater shifts his or her weight (e.g., by leaning to make a turn), the skater "rocks" slightly forwards or backwards on the blade. The skater must make subtle movements to maintain balance and control during this rocking motion. Additionally, the curvature of the blade means that less of the blade contacts the ice surface. Therefore, skaters have less of the blade on which to balance and control their skating movements.

SUMMARY

The present invention comprises a blade for an ice skate, for example. In one embodiment, the blade comprises a front curved section, a rear curved section, and a substantially flat middle section. The front and rear curved sections include a front balance point and a rear balance point, respectively. The substantially flat middle section extends between the front and rear curved sections, and includes a center balance point. The front, rear, and center balance points are points on the blade over which the skater's center of gravity lies when the skater performs various movements on an ice surface.

The substantially flat middle section places more of the blade in contact with the ice surface. It also minimizes the distance between the front and rear balance points and the ice surface, and thus, reduces the distance through which a skater "rocks" on the blade while skating. In one embodiment, for example, the blade is shaped such that the amount of the blade that extends from a bottom edge of a blade holder at the rear balance point is equal to or slightly greater than the amount of the blade that extends from the bottom edge of the blade holder at the front balance point. This spaces the front and rear balance points above a line extending tangentially to the center balance point by distances that are between about $1/128^{th}$ of an inch and $1/32^{nd}$ of an inch. The rear balance point is spaced above the tangent line by a distance that is greater than or equal to the distance between the front balance point and the tangent line.

Forming or shaping the blade according to one embodiment of the present invention includes determining a placement for each of the balance points. In one embodiment, the front balance point is located between 1-3 inches from the toe of the blade. The rear balance point is located 1-2 inches from the heel of the blade. The center balance point is located such that it roughly bisects the length of the blade. Once the balance points are determined, the middle section is shaped to be flat or substantially flat. Shaping the blade may continue until the front and rear balance points are between about $1/128^{th}$ of an inch and $1/32^{nd}$ of an inch above the tangent line extending through the center balance point.

DETAILED DESCRIPTION

Figure 1:
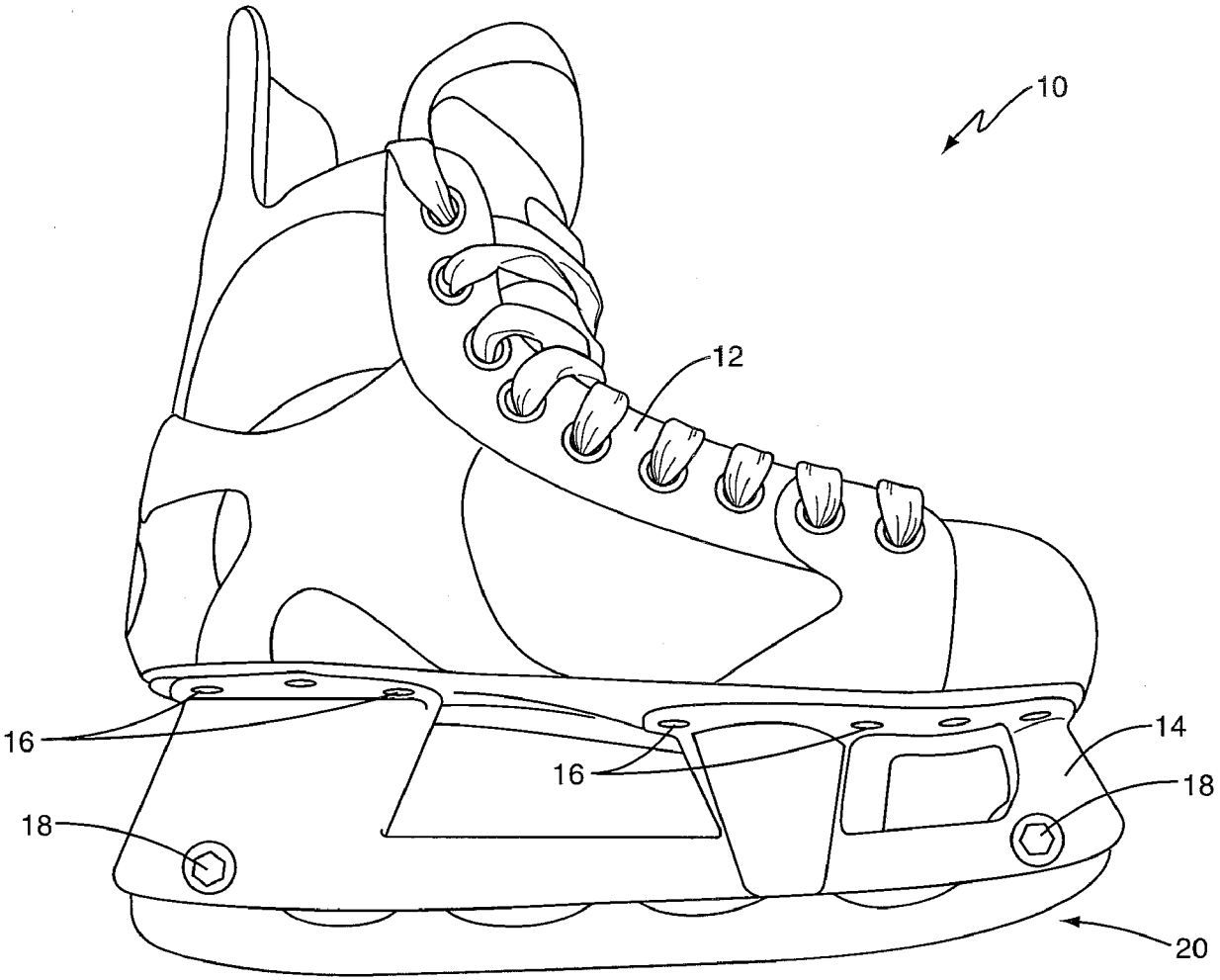
FIG. 1 is a perspective view of an ice skate including a skate blade shaped according to one embodiment of the present invention.

The present invention comprises a blade for ice skates and to a method for forming or shaping the blade. The present invention is particularly useful for hockey skates, which typically have a curved profile. The present invention could also be employed with other types of skates, such as skates for figure skating and speed skating. The present invention is based on the observation that there are three balance points along the bottom edge 28 of the blade, referred to herein as the front balance point 42, the center balance point 62, and the rear balance point 52. The balance points 42, 52, 62 are points on the blade over which the skater's center of gravity lies when the skater performs various movements on an ice surface. The blade according to the present invention is shaped to maintain critical vertical distances between the three balance points 42, 52, 62, and a line that runs tangentially to the center balance point 52. One result is that the front and rear balance points 42, 52 are bought closer to the ice surface giving a skater greater balance, speed, agility, and control while performing various movements and motions on the ice surface.

FIG. 1, for example, illustrates a perspective view of an ice skate 10 that includes a blade shaped according to one embodiment of the present invention. Skate 10 comprises a boot 12 that encloses a skater's foot, a blade holder 14, and a skate blade 20. The blade holder 14 connects to the sole of the boot 12 using a plurality of mechanical fasteners such as rivets 16. The skate blade 20 connects to the blade holder 14 using one or more mechanical fasteners such as bolt 18. The mechanical fasteners 16, 18 permit technicians or other knowledgeable personnel to replace the blade holder 14 and/or the skate blade 20 as needed or desired. Those skilled in the art will readily appreciate that the skate 10 and its component parts may be any skate known in the art. Examples of suitable skates include, but are not limited to, those manufactured by such companies such as BAUER, CCM, NIKE, REEBOK, and the like.

Figure 2:
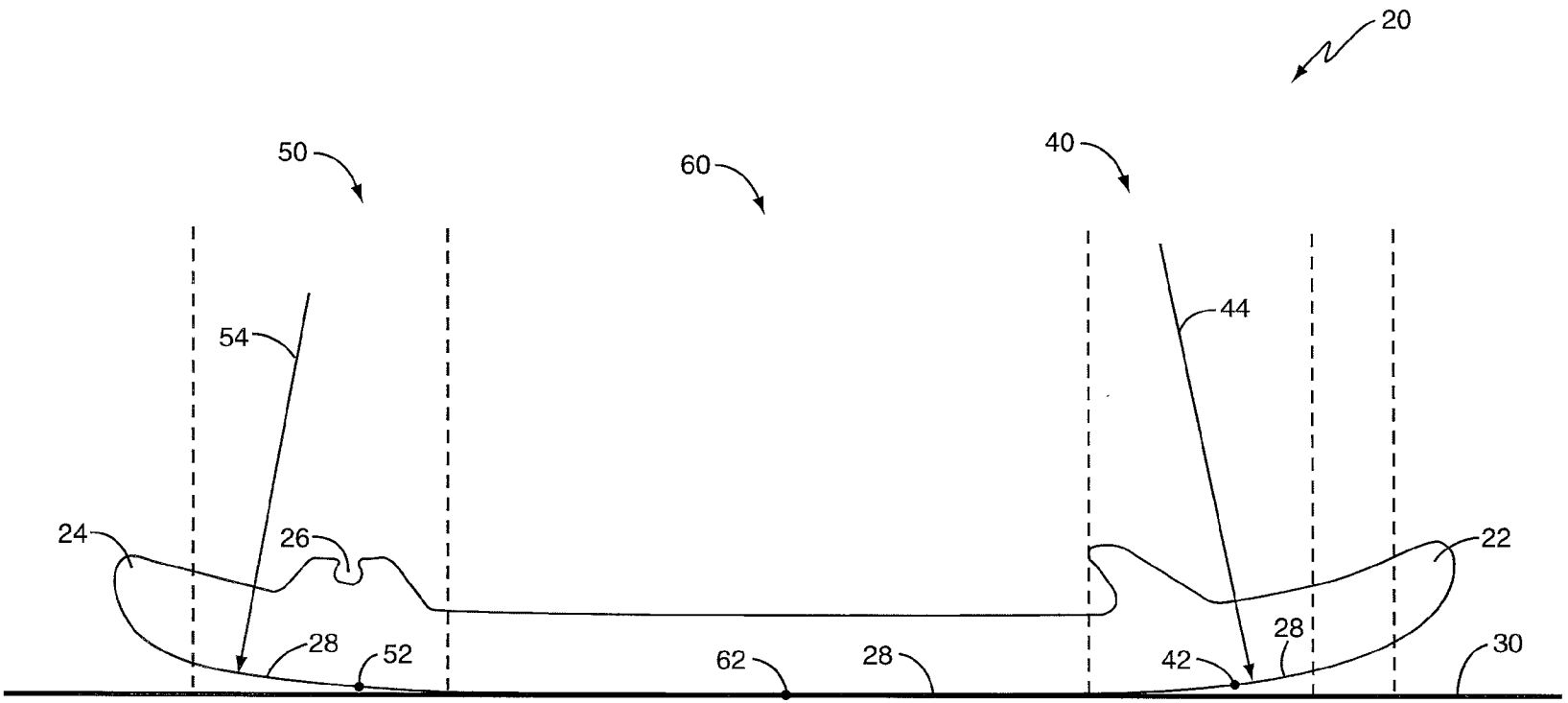
FIG. 2 is a perspective view of a skate blade shaped according to one embodiment of the present invention.

FIG. 2 illustrates a perspective view of skate blade 20 shaped according to one embodiment of the present invention. Skate blade 20 is typically constructed as a unitary plate of elongated steel approximately 1/32 and 3/16 of an inch thick.

The skate blade 20 includes a toe section 22, a front curved section 40, a center section 60, a rear curved section, 50 and a heel section 24. The toe and heel sections 22, 24 include an opening 26 to receive the bolt 18 that attaches the skate blade 20 to the blade holder 14. A bottom edge 28 of the front curved section 40, center section 60 and rear curved section 50 contacts the ice surface while the user is skating. As described in more detail below, the bottom edge 28 is shaped such that more of bottom edge 28 contacts the ice surface than does a conventionally shaped skate blade, thus providing a skater with greater balance, speed, agility, and control.

The front curved section 40 may contact the ice surface while skating and includes the front balance point 42. The front balance point 42 is spaced vertically above a line 30 that extends tangentially to a center balance point 62 on skate blade 20 by a distance $d_1$. The front balance point 42 is the point on blade 20 above which a skater's center of gravity generally lies when the skater performs various movements on the ice surface 30 such as turning. The bottom edge 28 in the front curved section 40 is shaped as an arc of a circle having a radius 44. In this embodiment, radius 44 is between approximately 6 and 10 feet in length. However, those skilled in the art will appreciate that radius 44 may be any length desired.

The rear curved section 50 also contacts the ice surface while skating and includes the rear balance point 52. The rear balance point 42 is the point on blade 20 above which a skater's center of gravity generally lies when the skater performs other movements on the ice surface 30 such as coming out of a turn. The rear balance point is spaced vertically above a line that extends tangentially to a center balance point 62 on skate blade 20 by a distance $d_2$. The bottom edge 28 in the rear curved section 50 is also shaped as an arc of a circle having a radius 54. As above, radius 54 may be between approximately 6 and 10 feet in length. However, it should be understood that radius 54, like radius 44, may be any length needed or desired.

As seen in FIG. 2, the bottom edge 28 in each of the front and rear curved sections 40, 50 have a constant radius of curvature. These radii may be the same or different. In one exemplary embodiment, the radius of the front curved section is greater than or equal to the radius of the rear curved section. Most preferably, the radius of the rear curved section is less than the radius of the front curved section. In some embodiments the front and/or rear sections 40, 50 may have a compound curvature wherein the radius of curvature changes along the length of the curve.

The middle section 60 includes a center balance point 62 that lies in contact with the ice surface. Generally, the center balance point 62 is located on the blade 20 such that it roughly bisects the length of blade 20. However, the center balance point 62 may be located slightly forward or rearward of the center of the blade 20 according to the preferences of the skater. Center balance point 62 is the point on blade 20 above which a skater's center of gravity generally lies when the skate 10 is at rest on the ice surface. The bottom edge 28 in middle section 60 is flat or substantially flat, meaning that it has a very large radius of curvature Shaping the bottom edge 28 such that it is flat or substantially flat allows more of the bottom edge 28 to contact the ice surface for increased stability and control. In addition, it brings the front and rear balance points 42, 52 closer to the tangent line 30, and thus, reduces the vertical distance between the front and rear balance points 42, 52, and the center balance point. As a consequence, the front and rear balance points 42, 52 are closer to the ice surface, and the distance through which the skater rocks forwards and backwards on skate blade 20 is reduced when performing various maneuvers such as turning.

Figure 3:
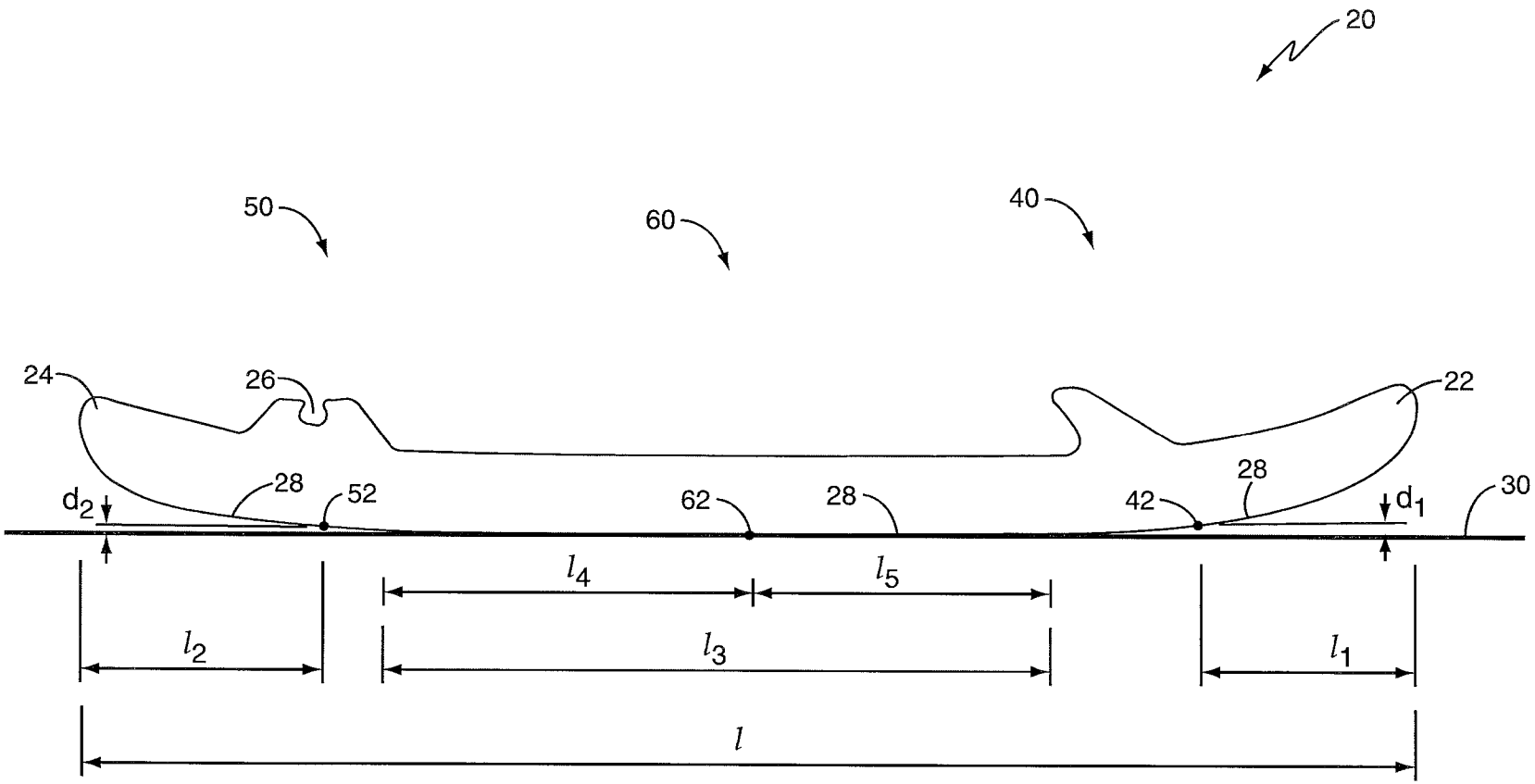
FIG. 3 is a perspective view of the skate blade of FIG. 2 illustrating possible placements for balance points according to one embodiment of the present invention.

FIG. 3 illustrates possible placements of the front, rear, and center balance points 42, 52, and 62 on the bottom edge 28 of skate blade 20 according to one embodiment of the present invention. Placement of the balance points may be based on the length of the skate blade 20. For example, skate blade 20 has a length l, which may vary for different sizes of skate 10. For an adult skate, length l is typically in the range of 9-16 inches. For youth skates, the length l is typically in the range of 4-9 inches. The center balance point 62 is located on the bottom edge 28 of skate blade 20 such that it roughly bisects the length l. The front and rear balance points 42, 52 are located on the skate blade 20 such that they are spaced away from the toe 22 and heel 24 of blade 20, respectively. In the exemplary embodiment described herein, the front balance point 42 is spaced from the toe 22 by a distance $l_1$ of approximately 1-3 inches, and the rear balance point 52 is spaced from the heel 24 by a distance $l_2$ of approximately 1-2 inches.

As previously stated, the bottom edge 28 in middle section 60 is shaped to be substantially flat to reduce the vertical distance between the front and rear balance points 42, 52 and the center balance point 62. In one embodiment, the distance $d_1$ between the front balance point 42 and the center balance point is between about $1/128^{th}$ of an inch and $1/32^{nd}$ of an inch. Likewise, the distance $d_2$ between the rear balance point 42 and the tangent line 30 is between about $1/128^{th}$ of an inch and $1/32^{nd}$ of an inch. The distances $d_1$ and $d_2$ may the same or different. However, the distance $d_2$ is preferably equal to or greater than the distance $d_1$. Most preferably, the distance $d_2$ is greater than the distance $d_1$. Thus, the rear balance point 52 is at least equal to or higher than the front balance point 42 with respect to the center balance point 62.

The substantially flat portion of bottom edge 28 extends along the skate blade 20 for a total length $l_3$, and away from center balance point 62 in opposite directions for lengths $l_4$ and $l_5$. In one embodiment, length $l_3$ is approximately 60 mm, and lengths $l_4$ and $l_5$ are 30 mm each. These lengths need not be equal, however. In some embodiments, lengths $l_4$ and $l_5$ are unequal, for example, 25 and 35 mm, respectively. The lengths $l_3$-$l_5$ may be determined or adjusted according to the personal preferences and/or ability of the skater.

Figure 4:
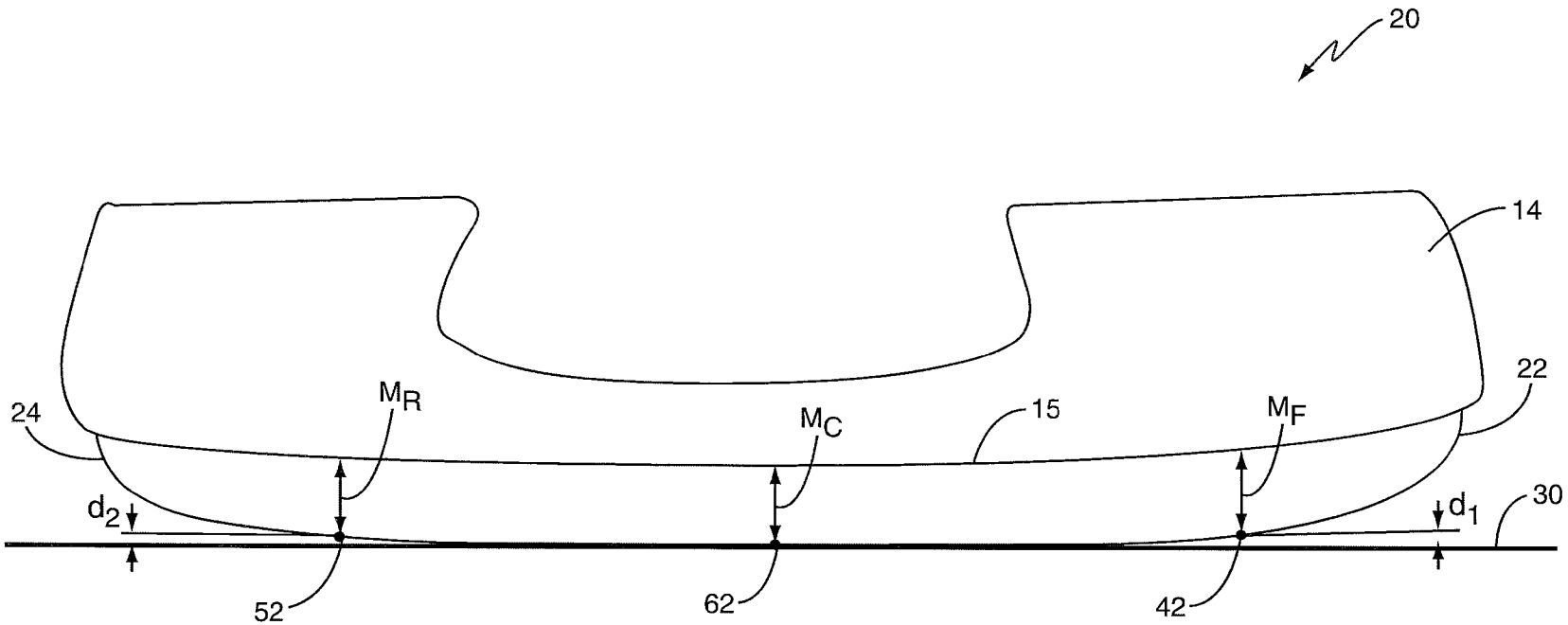
FIG. 4 illustrates a blade attached to a blade holder according to one embodiment of the present invention.

FIG. 4 illustrates a side view of blade 20 attached to the blade holder 14 and shaped according to one embodiment of the present invention. As seen in FIG. 4, a rear measurement $m_R$ is the length of blade 20 that extends away from the bottom edge 15 of the blade holder 14 at the rear balance point 52. A center measurement $m_C$ is the length of blade 20 that extends, away from the bottom edge 15 of the blade holder 14 at the center balance point 62. A front measurement $m_F$ is the length of blade 20 that extends away from the bottom edge 15 of the blade holder 14 at the front balance point 62. Preferably, the value of $m_R$ is higher than the value of $m_F$ but is within a specified tolerance of about $1/32^{nd}$ of an inch. The value of $m_R$ could be equal to the value of $m_F$, but should never be lower than the value of $m_F$. Thus, more of the blade 20 should extend away from the rear of the blade holder 14 than from the front of the blade holder 14. This stabilizes the skater on the ice surface by helping the skater to maintain his weight forward, and by preventing the skater from rocking back on the blade 20 during some maneuvers, such as when the skater is coming out of a turn, for example.

By way of example, the value of $m_F$ in FIG. 4 is approximately $33/64^{th}$ of an inch. Thus, the value of $m_R$ is preferably about $35/64^{th}$ of an inch, but is never less than $33/64^{th}$ of an inch. The value of $m_C$ is preferably equal to $33/64^{th}$ of an inch but may be $35/64^{th}$ of an inch (i.e., $1/32^{nd}$ of an inch greater than $m_R$ or $m_F$).

Figure 5A:
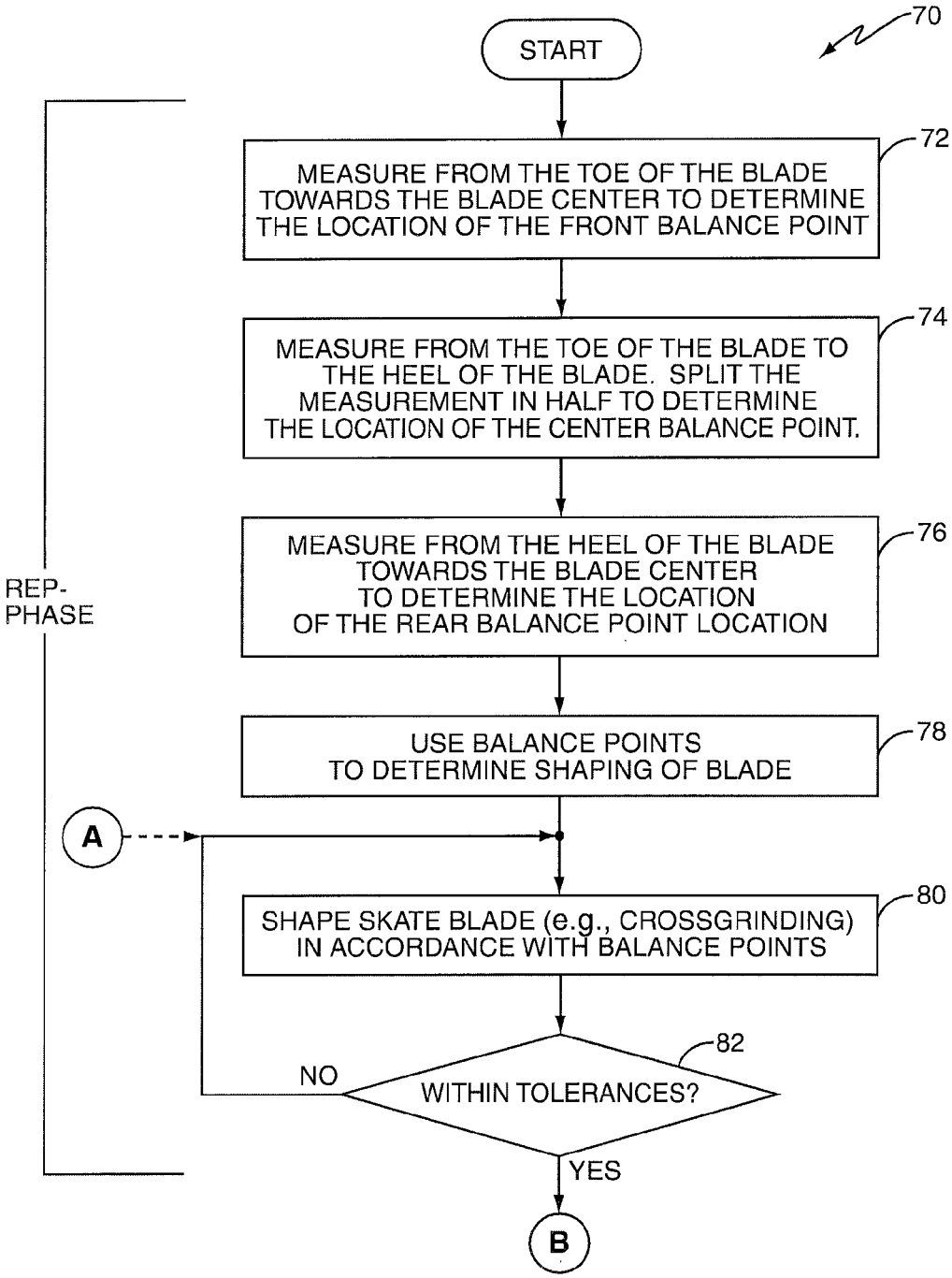
FIGS. 5A-5B are flow charts illustrating a method of shaping a skate blade according to one embodiment of the present invention.
Figure 5B:
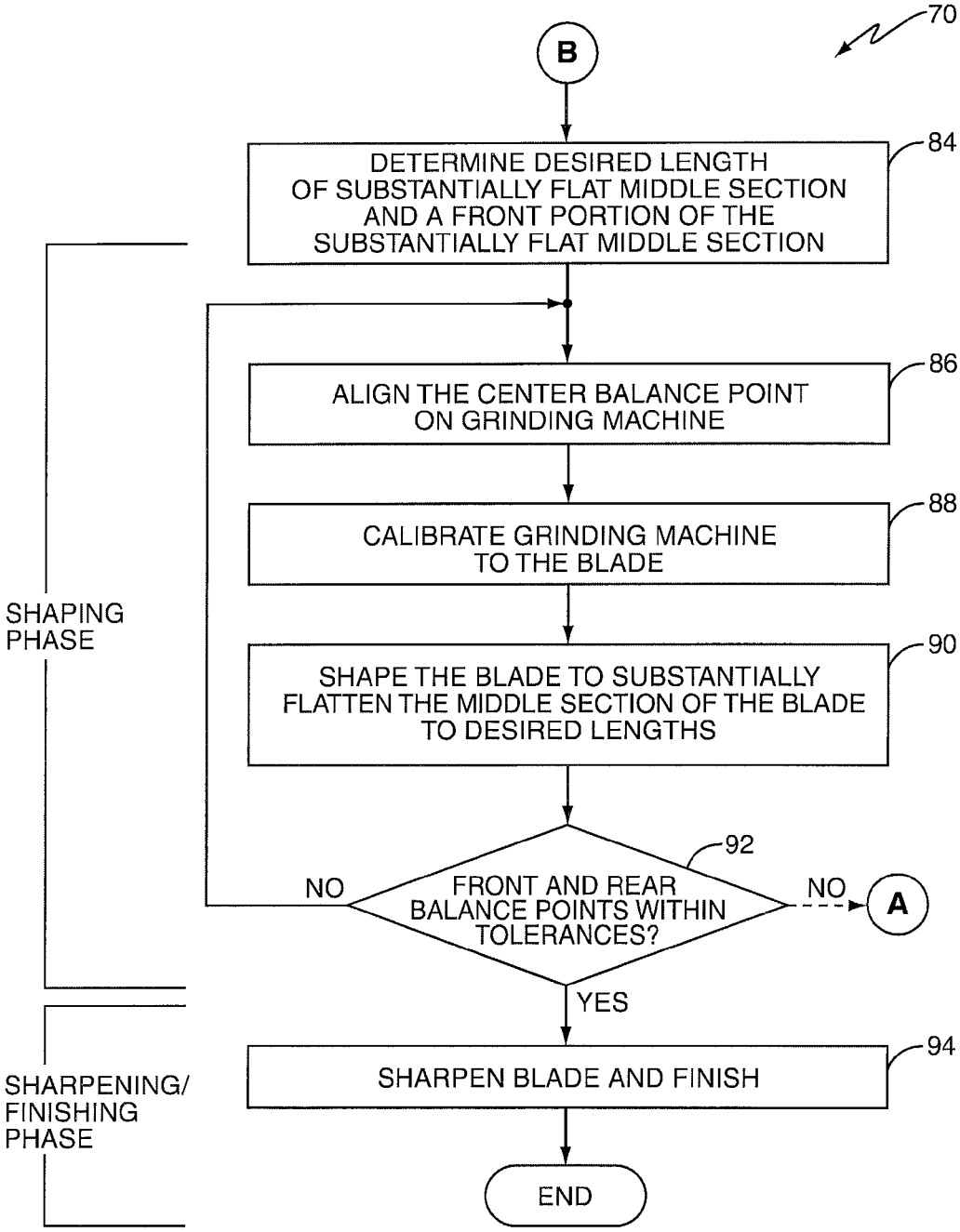

Shaping the skate blade 20 according to the present invention may be accomplished after the blade 20 is manufactured and before or after the blade 20 is installed on skate 10. For example, a skater may have a skate that includes a conventionally curved blade. This conventionally curved blade may be ground and sharpened to include a flat or substantially flat middle section 60, and such that the front and rear balance points 42, 52 are within $1/128^{th}$ and $1/32^{nd}$ of an inch above tangent line 30. FIGS. 5A-5B illustrate such a method 70 by which skate blade 20 may be shaped during the sharpening process. For clarity, method 70 is described in three separate phases—a preparation phase, a shaping phase, and a sharpening or finishing phase. During the preparation phase, a person such as a skate technician roughly shapes the blade to within a desired tolerance. During the shaping phase, the person further grinds and sharpens the blade 20 to within desired tolerances. These first two phases may be repeated until the desired tolerances are achieved. During the finishing phase, the sharpening of the skate blade 20 is fine-tuned.

Method 70 begins by determining the placement of each of the front, rear, and center balance points. During this process, a marker may be used to place a dot or other indicator at the location of each of the front, rear, and center balance points 42, 52, and 62. A person sharpening the skate blade 20 measures from the edge of the toe 22 towards the center of the blade 20 to determine the placement of the front balance point 42 (box 72). As stated above, the front balance point 42 may be located on the skate blade 20 between about 1-3 inches from the toe 22, which places the front balance point 42 roughly under the ball of the skater's foot. The length of the blade 20 is then measured and split in half to determine the placement of the center balance point 62 (box 74). This places the center balance point 62 approximately midway along the length of skate blade 20. The person than measures from the edge of the heel 24 towards the center of the blade 20 to determine the placement of the rear balance point 52 (box 76). This places the rear balance point 52 roughly under the skater's ankle, and approximately 1-2 inches from the edge of the heel 24.

Once the location of balance points 42, 52, and 62 have been determined, the person sharpening the skate will prepare the blade 20 by cross grinding the blade. The person may use one or more of the balance points 42, 52, and 62 as a visual reference to determine where to grind the blade 20 (box 78). One way to accomplish this is to balance the blade 20 on a smooth flat work surface to and visually inspect the blade 20 to identify areas that need grinding. The visual inspection will reveal where to grind the blade 20 such that the blade 20 balances substantially at the center balance point 62. Balancing adjustments may be made, however, based on the personal preferences of the skater, the length of the blade 20, or upon the age or ability of the skater, for example.

Once the person sharpening the blade 20 knows how and where to shape the blade 20, the person than "cross grinds" the blade 20 according to the balance points 42, 52, 62 to begin to substantially flatten the middle section 60 (box 80). During cross grinding, the bottom edge 28 of blade 20 is brought into contact with a rotating stone wheel. The blade 20 is moved along its length with the bottom edge 28 in contact with the rotating wheel. In one embodiment, the person cross grinds the blade 20 between the front and rear balance points 42, 52 to begin to substantially flatten the middle section 60 of the blade 20.

After cross grinding, the person may balance the bottom edge 28 of the blade 20 on the smooth flat surface to determine whether the front and rear balance points 42, 52 are within desired tolerances (box 82). The check may include, for example, ensuring that the distances $d_1$, $d_2$ are roughly spaced the desired distances from the flat smooth surface. Additionally, the person may also obtain measurement values for $m_R$, $m_C$, and $m_F$ to ensure that more of the blade 20 extends from the bottom edge 15 of the blade holder 14 at the rear than at the front. As stated above, $m_R$ is preferably $1/32^{nd}$ of an inch greater than $m_F$, but could be equal to $m_F$. However, $m_R$ can never be lower than $m_F$. The person may repeat the cross grinding process (box 80) until the distances $d_1$, $d_2$ and/or $m_R$, $m_C$, and $m_F$ are within desired tolerances.

Once the blade 20 is prepared, the person sharpening the blade 20 determines the total desired length $l_3$ of the substantially flat portion of the middle section 60. The person also determines the length $l_5$ of the substantially flat portion extending along the bottom edge 28 from the center balance point 62 towards the front balance point 52 (box 84). Alternatively, however, the person may determine the length $l_4$ extending along the bottom edge 28 from the center balance point 62 towards the rear balance point 52. These values are then used to further shape and balance the skate blade 20.

By way of example, the values for $l_3$ and $l_4$ (or alternatively $l_5$) may be entered into an automated skate balancing machine, such as the CAG ONE manufactured by Skate Sharpeners Inc., in Ontario, Canada; however, other computer-aided grinding machines may also be suitable.

The person sharpening the skate blade 20 aligns the center balance point 62 to a corresponding point on the machine and secures the skate 10 to the machine (box 86). The machine automatically calibrates itself to the blade 20 by calculating a number of passes it will need to grind the bottom edge 28 according to the input values for the lengths (box 88). A rotating grinding wheel than makes the calculated number of passes along the length of bottom edge 28 between the front and rear balance points 42, 52 to contact and flatten the middle section 60 (box 90). With these machines, the grinding wheel may also contact portions of the front and/or rear sections 40, 50, applying varying amounts of pressure to the bottom edge 28 to shape the skate blade according to the input values. Once complete, the machine stops and the person sharpening the skate may fine tune the edges of blade 20.

Fine tuning may require that the person check that the front and rear balance points 42, 52 are within the desired tolerances (box 92). By way of example, the person may set the skate 10 on the flat, sturdy work surface such that the skate 10 rests or balances on the center balance point 62. Using a ruler or other graduated instrument, the person may check to ensure that the front and rear balance points 42, 52 are between about $1/128^{th}$ of an inch and $1/32^{nd}$ of an inch above the work surface. Additionally, the person may check to ensure that the distance between the rear balance point 52 and the work surface is equal to or greater than the distance between the front balance point 42 and the work surface. The person should also obtain measurement values for $m_R$, $m_C$, and $m_F$ to ensure that more of the blade 20 extends from the bottom edge 15 of the blade holder 14 at the rear than at the front. As above, tolerances may be within $\pm 1/32^{nd}$ of an inch.

The person may continue to shape the bottom edge 28 of blade 20 (box 90) until the front and rear balance points 42, 52 are determined to be within acceptable tolerances (box 92). In some cases, the person sharpening the blade 20 may also repeat the cross grinding process (box 80) if the tolerances fall outside the acceptable range. Once the blade 20 is shaped, the person may sharpen and fine tune the blade 20 to ensure that blade 20 has sharp edges (box 94).

It should be noted that method 70 is described in the context of skate sharpening. However, the method 70 may also be employed during the manufacturing process. Particularly, skate blade manufacturers typically utilize a computer controlled process to control machines that stamp or cut the skate blades 20 from one or more sheets of material, such as steel. These manufacturing processes may be controlled to place one or more of the balance points 42, 52, and 62, and stamp or cut the skate blades 20 such that they emerge from the manufacturing process having a substantially flat middle section 60. Alternatively, the skates may be mass produced using known methods, and then shaped according to the present invention prior to release for public consumption.

Additionally, the preceding description and the figures relate an embodiment of the present invention in terms of a skate blade for an ice hockey skate. However, those skilled in the art will appreciate that the utilization of an ice hockey skate is for illustrative purposes only. The present invention may be applied to shape or form the blades other skates including, but not limited to, figure skates.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A method of shaping a skate blade comprising:

identifying a front balance point in a front curved section of the skate blade, a rear balance point in a rear curved section of the skate blade, and a center balance point along a center section of the skate blade;

shaping the center section of the skate blade to be substantially flat;

shaping the front curved section of the skate blade to have a first curved profile such that the front balance point is spaced between about $1/128^{th}$ of an inch and $1/32^{nd}$ of an inch above the center balance point; and shaping a rear section of the skate blade to have a second curved profile such that the rear balance point is spaced between about $1/128^{th}$ of an inch and $1/32^{nd}$ of an inch above the center balance point.

2. The method of claim 1 wherein identifying the front balance point comprises determining a location along the length of the skate blade that is spaced from a toe of the blade between about 1-3 inches.

3. The method of claim 2 wherein identifying the rear balance point comprises determining a location along the length of the skate blade that is spaced from a heel of the skate blade between about 1-2 inches.

4. The method of claim 3 wherein identifying the center balance point comprises determining a location along the length of the skate blade that is about midway between the toe and the heel of the skate blade.

5. The method of claim 1 wherein identifying the front balance point comprises spacing the front balance point along the skate blade a first length from the center balance point.

6. The method of claim 5 wherein identifying the rear balance point comprises spacing the rear balance point along the skate blade a second length from the center balance point.

7. The method of claim 1 wherein shaping the middle section of the skate blade to be substantially flat comprises forming the skate blade such that a first length extending from the center balance point towards the front section is not less than a second length extending from the center balance point towards the rear section.

8. The method of claim 1 wherein shaping the middle section of the skate blade to be substantially flat comprises forming the skate blade such that a first length extending from the center balance point towards the rear section is greater than or equal to a second length extending from the center balance point towards the front section.

9. The method of claim 1 wherein shaping a rear section of the skate blade further comprises shaping the rear section of the skate blade such that a first vertical distance between the rear balance point and the tangent line is greater than or equal to a second vertical distance between the front balance point and the tangent line when the skate blade rests on the center balance point.

* * * * *